US006119779A

United States Patent [19]

Gipson et al.

[11] Patent Number: 6,119,779

[45] Date of Patent: Sep. 19, 2000

[54] METHOD AND SYSTEM FOR SEPARATING AND DISPOSING OF SOLIDS FROM PRODUCED FLUIDS

[75] Inventors: Larry Joe Gipson, Anchorage; Steven Leon Carn, Eagle River, both of Ak.

[73] Assignee: Atlantic Richfield Company, Los Angeles, Calif.

[21] Appl. No.: 09/188,133

[22] Filed: Nov. 9, 1998

[51] Int. Cl.[7] ..... E21B 43/40

[52] U.S. Cl. ..... 166/267; 166/75.12; 175/206; 210/806; 210/747; 210/181; 210/170

[58] Field of Search ..... 166/266, 267, 166/90.1, 75.12; 175/206, 207; 210/806, 768, 774, 787, 747, 181, 170

[56] References Cited

U.S. PATENT DOCUMENTS

| | | | |
|---|---|---|---|
| 4,627,923 | 12/1986 | Ross | 210/744 |
| 4,942,929 | 7/1990 | Malachosky et al. . | |
| 4,994,175 | 2/1991 | Hargreaves et al. | 208/424 |
| 5,109,933 | 5/1992 | Jackson . | |
| 5,129,469 | 7/1992 | Jackson . | |
| 5,303,786 | 4/1994 | Prestridge et al. . | |
| 5,314,265 | 5/1994 | Perkins et al. . | |
| 5,387,737 | 2/1995 | Schmidt et al. . | |
| 5,489,740 | 2/1996 | Fletcher . | |
| 5,516,434 | 5/1996 | Cairo, Jr. et al. | 210/703 |
| 5,685,374 | 11/1997 | Schmidt et al. | 166/269 |
| 5,755,974 | 5/1998 | McBrayer, Jr. et al. | 210/739 |
| 6,045,070 | 4/2000 | Davenport | 241/60 |

*Primary Examiner*—William Neuder
*Assistant Examiner*—Zakiya Walker

[57] ABSTRACT

A method and system for processing a production stream containing a substantial amount of sand for continuously separating and disposing of the sand by re-injecting the sand into a subterranean formation. The production stream is flowed through a separator (e.g. hydrocyclone) which separates the sand from the stream. The sand is continuously discharged from the separator into an accumulator which, in turn, feeds the sand into an eductor in which, to form a slurry. The slurry is then re-injected into a subterranean formation, thereby continuously disposing of the sand.

14 Claims, 2 Drawing Sheets

METHOD AND SYSTEM FOR SEPARATING AND DISPOSING OF SOLIDS FROM PRODUCED FLUIDS

DESCRIPTION

1. Technical Field

The present invention relates to a method and system for separating and disposing of solids from produced fluids and in one aspect relates to a method and system for continuously processing a production stream from a production well to separate solids (i.e. particulate material such as sand) from the stream and then dispose of the solids by injecting them into a subterranean formation through an injection well.

2. Background

Much of the world's known hydrocarbon reserves exists as "heavy-oil" found in subterranean reservoirs. Unfortunately, the productivity of such reservoirs is restricted by the large pressure drops normally required to induce flow of the heavy-oil from the reservoir. Thermal stimulation techniques (e.g. steam floods, in situ combustion, etc.), which reduce the viscosity of the heavy-oil in place, are successful in producing many reservoirs of this type but unfortunately, there are other heavy-oil reservoirs which are not good candidates for thermal stimulation techniques.

In such reservoirs, one non-thermal method of production (sometime referred to in the industry as "Cold Production") has been found effective in producing the heavy-oil. The near-wellbore region is stimulated and a high differential pressure is maintained between the reservoir and the production wellbore during production thereby actually encouraging the production of formation solids, e.g. collectively called "sand", along with the production fluids, e.g. heavy crude. While this method allows the viscous crudes to flow naturally into the wellbore for production to the surface, it unfortunately results in the production of large amounts of sand along with the production fluids. As will be recognized in the art, the separation, handling, and disposal of these large amounts of sand present a major problem in the economical production of heavy-oil by Cold Production.

More specifically, as a result of the encouraged sand production required in Cold Production methods, significant costs are incurred in (a) separating the sand from the production stream once the crude has been produced to the surface and (b) handling and disposing of the sand once it has been separated from the crude. Typically, Cold Production wells are tied into a vertical tank(s) in which the solids are allowed to set for a period of time in order to allow the sand to settle out of the heavy crude. The sand is then removed from the bottom of tank and is hauled to a dedicated storage facility for further processing and/or disposal.

Environmental concerns related to the disposal of this sand from these storage sites have recently led to an increasing use of subsurface re-injection as a preferable alternative to surface storage and/or disposal of the sand. The sand is taken from storage and is mixed into a slurry which, in turn, is pumped into a subterranean formation through an injection well. Unfortunately, however, these disposal techniques are still relatively time consuming and expensive in that typically they still use settling tanks for separating the sand from the production stream which, in turn, still requires basically the same amount of hauling, handling, and storage of the separated sand before it can be disposed of by re-injection.

SUMMARY OF THE INVENTION

The present invention provides a method and system for processing a production stream having a substantial amount of solids (i.e. sand) therein for continuously separating and disposing of the sand by re-injecting the sand into a subterranean formation through an injection well. Basically, the production stream is flowed through a separator which separates substantially all of the sand from the stream. The fluids (crude, gas, water) are removed from the separator through a first outlet while the separated sands are discharged through a separate outlet to an accumulator wherein the sand is collected.

A valve adjusts the amount of sand which then flows from the bottom of the accumulator into an eductor in which, a slurry is formed with water being flowed through the eductor. The slurry then flows from the eductor to a wellhead of an injection well through which the slurry is injected into a subterranean formation, thereby continuously disposing of the sand.

More specifically, the present invention provides a method for separating and disposing of sand from a production stream wherein the production stream is passed through a separator (e.g. hydrocyclone, centrifuge, etc.) to separate substantially all of said sand from said production stream. The production stream may be heated by passing it through a heater prior to flowing the stream into the hydrocyclone. The separated sand is discharged from the separator into an accumulator where the sand is screened to separate out the larger particles of the sand. These larger particles accumulate on the screen and at appropriate times are removed from the accumulator by back-washing.

The smaller particles of sand which pass through the screen are fed at a controlled rate into an eductor which, in turn, is comprised of a length of pipe having a reduced diameter portion which forms a nozzle therein. The sand is drawn into the eductor by the low pressure zone formed at the outlet of the nozzle and mixes with the fluid (e.g. water) to form a slurry. The slurry then flows through a flowline on to the injection well where it is re-injected into a subterranean formation. A densitometer is positioned within the flowline downstream of said eductor for measuring the density of said slurry in the flowline. The densitometer generates a signal which, in turn, is used to control the flowrate of both the sand from the accumulator and the flowrate of the fluid through the eductor to, in turn, control the density of the slurry.

It can be seen that the present invention provides a continuous processing of a production stream in that the stream is flowed through a separator which continuously removes the sand from the stream. This sand is then collected in an accumulator from which it is then fed at a continuous, controlled rate into an eductor where it is mixed with water to form a slurry which, in turn, is injected into a subterranean formation for disposal. The present invention does not require any settling tanks or the lost time associated therewith which greatly increases the overall efficiency of the disposal operation.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
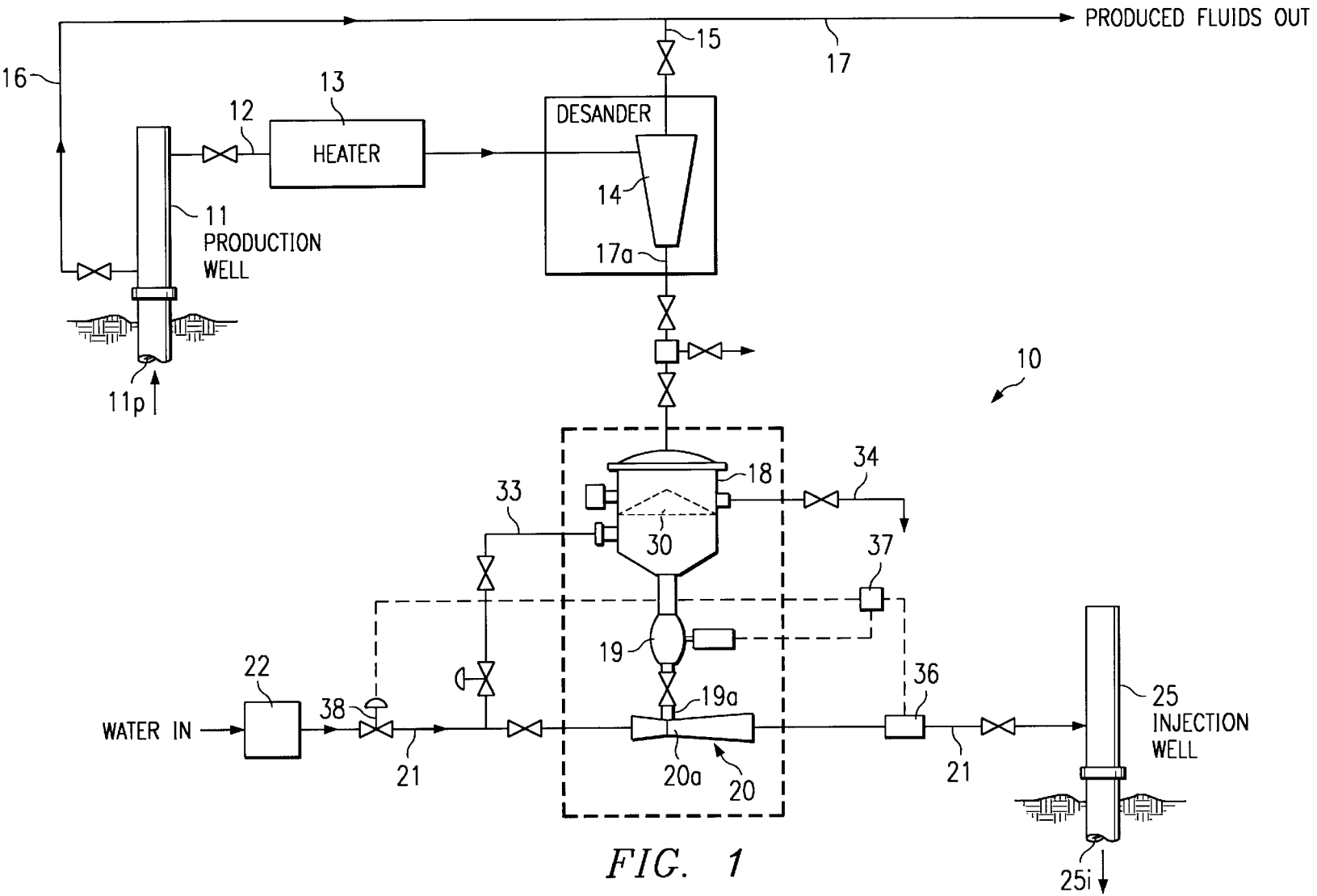
FIG. 1 is a, flow diagram of the separation and disposal system of the present invention.

Referring more particularly to the drawings, FIG. 1 is a flow diagram illustrating the separation and disposal system 10 of the present invention wherein the system is adapted to continuously process a production stream of hydrocarbons (e.g. heavy crude oil) having particulate solids (e.g. collectively called "sand") therein. An example of such a production stream is one which is typically produced during "Cold Production" of heavy-oil from a reservoir and one which normally contains a substantial amount of sand (e.g. from about 1% to about 50% by volume of gas-free crude).

The sand-laden stream is produced through line 12 from wellhead 11 of production well 11*p* and flows to "desander (s)" 14 (only one shown). Desander 14 can be any type of separator which is capable of continuously separating substantially all of the sand from the fluids in the production stream as the stream flows therethrough; e.g. a hydrocyclone of the type universally used to separate sand from drilling muds and the like.

As will be understood in the art, hydrocyclone 14 separates substantially all of the sand from the fluids (i.e. hydrocarbons, water, gas) in the production stream by centrifugal/gravitational forces as the stream flows therethrough. To facilitate separation, the sand-laden crude production stream may be heated by passing it through a heater 13 before the stream enters hydrocyclone 14. The fluids from the stream are discharged from hydrocyclone 14 through a first outlet 15 and may be combined with the fluids (i.e. annular gas) in line 16 from production wellhead 11 before the combined fluids are passed on through line 17 for further processing.

The sand, which is separated from the stream within hydrocyclone 14, is discharged from the hydrocyclone through a second, separate outlet 17*a* and flows into one or more accumulator vessels 18 (only one shown) from which the sand can then be fed at a desire rate through valve 19 and line 19*a* into an eductor 20 in injection line 21. Eductor 20 is comprised of a length of pipe whose diameter converges inwardly, intermediate its ends, to provide a restricted passage or nozzle 20*a* therein. Line 19*a* from accumulator 18 is connected into eductor 20 at the outlet of nozzle 20*a* for a purpose which will become clear below. The upstream end injection line 21 is connected through a pump 22 or the like to a source (not shown) of injection fluid (e.g. water) while the downstream end of injection line 21 is connected to wellhead 25 of an injection well 25*i*.

In operation, a sand-laden stream is produced from production wellhead 11, heated in heater 13 if desired, and is flowed through hydrocyclone 14 wherein substantially all of the sand is separated from the fluids in the stream. The fluids exits hydrocyclone 14 through first outlet 15 and are passed on for further processing through line 17. The separated sand is discharged from hydrocyclone 14 through second outlet 17 and is collected in accumulator 18. Fluid, e.g. water, is pumped under pressure through injection line 21 by pump 22 and into eductor 20. Due to the known "Bernoulli effect", the increase in the velocity of the water as it is forced through nozzle 20*a* in eductor 20 creates an area or zone of relatively low pressure adjacent the outlet of the nozzle which, in turn, "sucks" or draws in sand from line 19*a* into the water stream flowing through eductor 20. The sand mixes with the water to form a slurry as it flows out of eductor 20. The slurry of sand and water flows from the eductor and through injection line 21 and is injected into injection well 25*i* through wellhead 25.

Figure 2:
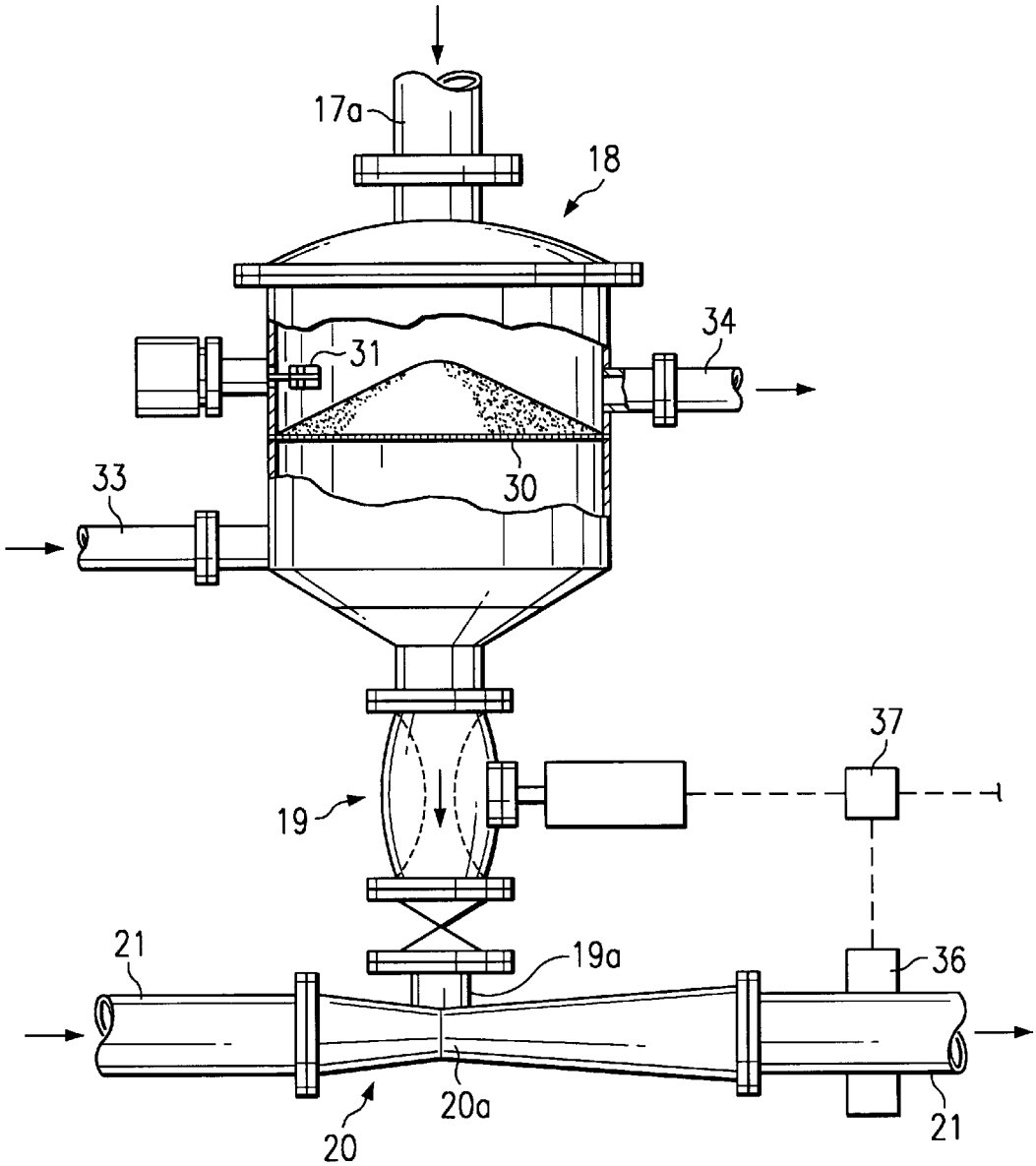
FIG. 2 is an enlarged, elevational view, partly in section, of the accumulator/eductor section of the system of FIG. 1.

To protect eductor 20 and control the particle size of the sand being re-injected into well 25*i*, a wedge-shaped, wire trash screen 30 is installed in accumulator 18 as best seen in FIG. 2. Screen 30 prevents shale chunks, large pebbles, etc. from flowing out of the accumulator and into the eductor 20; thereby preventing blocking or potential damage to the system. An alarm actuated by differential pressure, flowrate, or by a level sensor 31 is positioned in accumulator 18 above screen 30 will alert an operator that trash has accumulated on screen 30 to an extend that the screen needs to be cleaned before the process is continued. While screen 30 can be cleaned manually by removing the top of accumulator 18, preferably the screen is "back-washed" by diverting water line 21 through line 33 into accumulator 18 below screen 30. This water will flow upward through the screen 30 and remove and trash and debris through waste outlet 34.

It is also desirable to maintain a relatively constant injection rate of the slurry into the injection well, this rate being based on the amount of sand which will need to be disposed of during the continuous production from well 11. This injection rate will be controlled by adjusting the density of the slurry as it passes from eductor 20 to well 25*i*. This control may be achieved by installing a densitometer 36 in line 21 downstream from nozzle 20*a* which generates a signal representative of the density of the slurry passing therethrough. Densitometer 36 can be of the type which are commercially-available for measuring the density of slurries used in hydraulic fracturing operations (e.g. BJ Model DB III Densimeter, Baker-Hughes, Houston, Tex.). The signal from densitometer 36 controls both valve 19 from accumulator 18 and valve 38 in injection line 21 through controller 37 (see FIG. 1) to thereby adjust the amounts of sand and water, respectively, which flow through eductor 20.

While obviously, the specific parameters (e.g. the total amount of sand which can be continuously disposed; the density of the slurry, operating and injection pressures, etc.) of the present invention will depend on the particular application in which it is used, the following illustrates parameters which could be encountered in a typical Cold Production operation: a slurry injection rate of between 4 to 20 bpm (barrels per minute) or higher wherein the density of the slurry, itself, might be as high as 10–20 ppg (pounds per gallon) of sand while at the same time, keeping the operating pressures within the system below 1500 psig in many instances.

What is claimed is:

1. A method for separating and disposing of sand from a production stream, said method comprising:

passing said production stream through a separator to separate substantially all of said sand from said production stream;

discharging said sand from said separator into an accumulator;

feeding said sand from said accumulator at a feed rate into an eductor where said sand is mixed with a fluid to form a slurry;

measuring the density of said slurry after it leaves said eductor;

adjusting said feed rate of said sand from said eductor in response to said density of said slurry; and injecting said slurry into a subterranean formation through an injection well.

2. The method of claim 1 wherein said separator is a hydrocyclone.

3. The method of claim 1 wherein said separator is a centrifuge.

4. The method of claim 1 including:

heating said production stream before passing said stream through said separator.

5. The method of claim 1 wherein said fluid in said slurry is water.

6. The method of claim 5 including:

adjusting the flow of said water to said eductor in response to said density of said slurry.

7. A method for separating and disposing of sand from a production stream, said method comprising:

passing said production stream through a separator to separate substantially all of said sand from said production stream;

discharging said sand from said separator onto a screen positioned within an accumulator;

removing said sand from said accumulator which does not pass through said screen by back-washing said screen;

feeding said sand which passes through said screen from said accumulator into an eductor where said sand is mixed with a fluid to form a slurry; and injecting said slurry into a subterranean formation through an injection well.

8. The method of claim 7 wherein said separator is a hydrocyclone.

9. The method of claim 7 wherein said separator is a centrifuge.

10. A system for separating and disposing of sand from a production stream, said system comprising:

a separator adapted to separate substantially all of said sand from said production stream;

an accumulator fluidly connected to said separator adapted to receive said sand from said separator;

an eductor having a nozzle therein;

means for fluidly connecting said accumulator to said eductor at the outlet of said nozzle therein;

means for flowing a fluid through said nozzle of said eductor whereby said fluid creates a low pressure zone adjacent said nozzle outlet which draws sand into said eductor to mix with said fluid to form a slurry;

means positioned within said flowline downstream of said eductor for measuring the density of said slurry and generating a signal representative thereof;

means for controlling the flowrate of sand from said accumulator to said eductor of said fluid to said eductor in response to said signal representative of the measured density of said slurry; and a flowline fluidly connecting said eductor to a wellhead of an injection well for injecting said slurry into a subterranean formation through said injection well.

11. The system of claim 10 wherein said separator is a hydrocyclone.

12. The system of claim 10 including:

a heater located upstream from said separator for heating said production stream prior to said stream passing through said hydrocyclone.

13. The system of claim 10 including:

a screen positioned within said accumulator prevents flow of larger particles of said sand from flowing therethrough and into said eductor.

14. The system of claim 10 wherein said eductor is comprised of a length of pipe having a reduced diameter forming said nozzle therein.

* * * * *